US006592048B2

(12) United States Patent
Motoki et al.

(10) Patent No.: US 6,592,048 B2
(45) Date of Patent: Jul. 15, 2003

(54) SPRAY METHOD FOR MONOLITHIC REFRACTORIES

(75) Inventors: Eiji Motoki, Kanagawa (JP); Katsumi Nonaka, Tokyo (JP)

(73) Assignee: Plibrico Japan Company Ltd., Tokyo (JP)

( * ) Notice: Subject to any disclaimer, the term of this patent is extended or adjusted under 35 U.S.C. 154(b) by 0 days.

(21) Appl. No.: 10/044,949

(22) Filed: Jan. 15, 2002

(65) Prior Publication Data

US 2002/0132057 A1 Sep. 19, 2002

(30) Foreign Application Priority Data

Jan. 16, 2001 (JP) ..... 2001-008263
Jan. 16, 2001 (JP) ..... 2001-008307

(51) Int. Cl.[7] ..... A62C 5/02

(52) U.S. Cl. ..... 239/8; 239/9; 239/10; 239/398; 239/418; 239/427; 239/427.3; 239/427.5

(58) Field of Search ..... 239/8, 9, 10, 398, 239/418, 419, 422, 427, 427.3, 427.5, 428

(56) References Cited

U.S. PATENT DOCUMENTS 4,225,083 A 9/1980 Kubo et al.
4,695,167 A * 9/1987 Mori et al. ..... 366/158.2
5,766,689 A * 6/1998 Ono ..... 427/421
5,976,632 A 11/1999 Gerber et al.
6,284,045 B1 * 9/2001 Nakamura et al. ..... 118/306
6,313,055 B1 * 11/2001 Cullen ..... 501/99

FOREIGN PATENT DOCUMENTS

JP 2002187781 A * 7/2002 ..... C04B/35/66

OTHER PUBLICATIONS

Patent Abstracts of Japan, JP 2000–356475, Dec. 26, 2000.
Derwent Abstract, AN. 1987–084047 (25), XP–002196510, JP 62–036071, Feb. 17, 1987.

* cited by examiner

*Primary Examiner*—Robin O. Evans
(74) *Attorney, Agent, or Firm*—Oblon, Spivak, McClelland, Maier & Neustadt, P.C.

(57) ABSTRACT

A spray method for monolithic refractories, which comprises feeding, with an air stream, a monolithic refractory composition including a rapid setting agent in addition to refractory aggregates, a refractory powder, a binder and a dispersant in a powder state in a transporting pipe so that the composition is transported in a floating state; adding application water on the way of the transporting pipe; continuing the feeding of the air stream, and spraying the wet composition through a spray nozzle. In a case that the monolithic refractory composition does not include the rapid setting agent, the rapid setting agent is added at an upstream side of the top end of the spray nozzle, and then, the wet refractory composition is sprayed through the spray nozzle. The spray method eliminates problems in conventional dry spray method or wet spray method; dispenses with the mixing work for the refractory composition; permits a long distance transportation of the refractory composition for a spray operation without causing the blocking of the transporting pipe, and provides sprayed refractories of high quality.

10 Claims, 3 Drawing Sheets

SPRAY METHOD FOR MONOLITHIC REFRACTORIES

The present invention relates to a novel method for producing sprayed monolithic refractories, which eliminates problems in conventional dry or wet spray method; dispenses with a mixing operation for a refractory composition to be sprayed, and enables a long distance transportation for a spray operation without causing the blocking of the refractory composition in the transporting pipe, whereby the applied monolithic refractories have a high quality.

As an advantageous method for monolithic refractories, a spray method has been known. This method requires no formwork for casting as a casting method does, and allows an easy operation even though the shape is complicated and even where frameworking is difficult. Accordingly, this method has been used widely in many fields in recent years. The spray method is generally classified into a dry spray method using a compressed air delivering system and a wet spray method using a pump-operated delivering system. These methods have the following merits or drawbacks.

In the dry spray method, a powdery refractory material to be sprayed, comprising a refractory powder such as clay which improves adhesively at the time of spraying and a binder such as aluminous cement which cures by adsorbing water, is supplied to a spray gun in the compressed air delivering system so that the refractory material is forcibly fed by compressed air in the transporting pipe. Then, water necessary for the operation, i.e. application water is added to the forcibly fed powdery refractory material at a spray nozzle portion to render the powdery refractory material with the application water to be a highly viscose adhesive state. Then, the wet refractory material is sprayed through the nozzle so that the material adheres and cures on a furnace wall portion, whereby a refractory furnace is fabricated.

In the dry spray method, since the refractory material to be sprayed is forcibly fed by air in a powdery state, there is little possibility of causing the blocking of the transporting pipe, and therefore, the transportation is easy and a long distance transportation is possible. Accordingly, the operation can be conducted by supplying the refractory material to be sprayed from a location where the spray machine is disposed on the ground to a remote place or a height.

However, the dry spray method has such disadvantage that a time of contact of application water with the refractory material to be sprayed is short since the viscose refractory material is produced by mixing the powdery refractory material with the application water in the nozzle. As a result, the application water can not sufficiently uniformly be mixed with the powdery refractory material to be sprayed, whereby the quality of a refractory furnace wall as an applied body is not uniform, the porosity is small, and refractories having a large strength and a high quality may not be obtained.

On the other hand, the wet spray method has been developed in obtaining a furnace wall having more uniform quality and more excellent in physical properties than that produced by the refractories obtained by the dry spray method, and therefore, has often been employed in recent years. In the wet spray method, a mixture called "mixed batch" is produced by mixing previously the refractory material to be sprayed with the application water in a sufficient manner. The mixed batch is produced by mixing them to such an extent that the flow value of flowability (according to JISR5201 with use of a cone) capable of pump-delivering with a mixer indicates about 200 mm, and the mixed batch is supplied to a delivery pump to be fed in the transporting pipe. Then, a rapid setting agent for agglomerating the mixed batch is added to the mixed batch at the nozzle portion, and the mixed batch is sprayed to a furnace wall structure by compressed air. Then, the refractories for the furnace wall can be fabricated by the agglomeration of the mixed batch relatively instantaneously.

In the wet spray method, since it is necessary to mix the refractory material to be sprayed with the application water with the mixer until a sufficient flowability is obtained before the refractory material is supplied to the delivering pump as described above, a large sized mixer and many workers are necessary. Further, in delivering the mixed batch by the pump, it is difficult to control the amount of mixing water in order to obtain a proper flowability. For example, when the flowability is small, the blocking may occur in the pump or the transporting pipe. On the other hand, when an excessive amount of mixing water is added in order to increase the flowability, there would occur separation of refractory aggregates of coarse particle and a fine powdery refractory powder which is contained in the refractory material to be sprayed. This creates problems that the transportation of the material is impossible and a preferred the spray operation can not be carried out. Thus, the wet spray method has many unstable factors in an application field at the time of the application.

In addition, in order to supply the mixed batch to a long distance location by the pump delivering to conduct the operation, the wet spray method requires a large sized pump because the viscosity of the mixed batch is large, and the distance of transportation is shorter, e.g. about 100 m at the maximum, than that in the dry spray method. Further, since a certain amount of the mixed batch remains in the transporting pipe when the operation has been finished, there are problems that the loss of the material is large and many workers and much time are required to remove the remaining mixed batch and to clean the equipment.

As disclosed in JP-A-62-36071, there has been known such a method that an amount of water of ⅕–¾ of the finally required amount of water for conducting the operation is added to a powdery refractory composition to be sprayed; the added water and the refractory composition are mixed previously by a mixer; the mixed refractory composition is forcibly supplied to a dry type spray gun, and a solution comprising the remaining amount of water for the operation and a curing accelerator is added to the refractory composition at a nozzle portion of the gun, whereby monolithic refractories can be formed by spraying the refractory composition.

In the disclosed method, however, it is necessary to add the aqueous solution comprising the curing accelerator and the application water to the refractory composition to be sprayed at the nozzle portion at the final stage, in the same manner as the conventional dry spray method. Accordingly, a time of contacting uniformly the necessary amount of water with the refractory material is too short to obtain a sufficient dispersing state of the refractory material to be sprayed, whereby it is difficult to form a furnace wall having a high quality. As a result, the disclosed method is within the scope of the conventional dry spray method, and can not be a method capable of improving the problems of the ordinary dry spray method. Further, the distance of transportation is short, i.e., 100 m at the maximum, in comparison with the conventional dry spray method, and therefore, there are many restrictions of locations at which the operation is to be conducted.

It is an object of the present invention to eliminate the problems in the conventional dry or wet spray method as described above.

Namely, the present invention is to provide a novel spray method for monolithic refractories, which does not require a mixing work for a refractory material to be sprayed, and permits a long distance transportation of the refractory material without causing the blocking of the transporting pipe, whereby monolithic refractories obtained by the operation have a high quality and uniform characteristics.

The present invention has been made based on new knowledge and idea obtained by analyzing sufficiently the characteristics of the dry and wet spray methods, whereby the above-mentioned object can be achieved.

Namely, the inventors of the present invention have found that monolithic refractories having excellent characteristics of the same level as those obtained by a wet spray method can easily be obtained by transporting a powdery monolithic refractory composition (Hereinbelow, referred to simply as refractory composition) and adding the total amount of application water on the way of the transferring pipe without the necessity of using the mixed batch which is obtained by sufficiently mixing previously. It is supposed that the refractory composition and the application water are mixed beyond expectation even if the total amount of the application water is added at a time on the way of the transferring pipe, unless the location of the addition is in the vicinity of the spray nozzle.

The inventors have forecasted first that when the total amount of the application water is added to the powdery monolithic refractory composition transferred in the transferring pipe, the viscosity would increase and the refractory composition adheres on the inner wall of the transferring pipe. However, it has been found that when a monolithic refractory composition containing a dispersant in addition to the refractory aggregates, the refractory powder and the binder is used as the powdery refractory composition to be transferred in the transferring pipe, and a rapid setting agent is added, on the way of transportation, at a location downstream from the location where the application water is added, it is possible to prevent effectively the blocking of the transferring pipe. Further, in the present invention, it has been found that a powdery monolithic refractory composition containing originally the rapid setting agent in addition to the refractory aggregates, the refractory powder, the binder and the dispersant, provided that the rapid setting agent is a powder type, can be transferred without causing rapid agglomeration and can be sprayed through the spray nozzle if the application water is added upstream from the spray nozzle within a predetermined distance.

Thus, the inventors of this application have made a successful development of the spray method for monolithic refractories by adding the application water on the way of the transporting pipe for feeding, with an air stream, a powdery monolithic refractory composition, whereby the above-mentioned problems in the conventional dry spray method and the wet spray method can be solved.

The present invention has many features as described below.

(1) A spray method for monolithic refractories, which comprises feeding, with an air stream, a monolithic refractory composition including refractory aggregates, a refractory powder, a binder and a dispersant in a powder state in a transporting pipe so that the composition is transported in a floating state; adding application water on the way of the transporting pipe; continuing the feeding of the air stream, and spraying the wet composition through a spray nozzle.

(2) The spray method for monolithic refractories described in the above (1), wherein the ratio of the maximum particle diameter of the refractory aggregates the inner diameter of the transporting pipe is 1/7–1/3.

(3) The spray method for monolithic refractories described in the above (1) or (2), wherein the monolithic refractory composition without including a rapid setting agent is used, and after the addition of the application water, the rapid setting agent is added at an upstream side of the top end of the spray nozzle.

(4) The spray method for monolithic refractories described in the above (3), wherein the rapid setting agent is added at a location of 0.3–2.5 m upstream from the top end of the spray nozzle.

(5) The spray method for monolithic refractories described in the above (3) or (4), wherein the application water is added at a location of 1–50m upstream from the location where the rapid setting agent is added.

(6) The spray method for monolithic refractories described in the above (1) or (2), wherein the monolithic refractory composition further comprises a rapid setting agent.

(7) The spray method for monolithic refractories described in the above (6), wherein the application water is added at a location of 0.3–15m upstream from the top end of the spray nozzle.

(8) The spray method for monolithic refractories described in any one of the above (1) to (7), wherein means for mixing uniformly the application water and the monolithic refractory composition in the transporting pipe are provided downstream from the location where the application water is added, and after the application water has been added, the application water is further mixed uniformly with the monolithic refractory composition.

(9) The spray method for monolithic refractories described in any one of the above (1) to (8), wherein the contents of the refractory powder, the binder, the dispersant and the rapid setting agent are 30–60 parts by mass, 2.5–20 parts by mass, 0.03–1.5 parts by mass and 0.07–4.5 parts by mass, respectively, per 100 parts by mass of the refractory aggregates.

(10) The spray method for monolithic refractories described in any one of the above (1) to (9), wherein the refractory powder is a ultra-fine refractory powder having a mean particle diameter of 10 $\mu$m or less; the binder is aluminous cement, and the dispersant is a condensed phosphate, a carboxylate or a sulfonate.

(11) The spray method for monolithic refractories described in any one of the above (1) to (10), wherein the amount of the rapid setting agent to be added is 0.05–3 parts by mass in terms of dry weight, per 100 parts by mass of the monolithic refractory composition excluding the dispersant.

(12) The spray method for monolithic refractories described in any one of the above (1) to (11), wherein the rapid setting agent is a silicate, aluminate, carbonate or sulfate of an alkali metal or alkaline earth metal.

(13) The spray method for monolithic refractories described in any one of the above (1) to (12), wherein the amount of the rapid setting agent to be added to the monolithic refractories is changed during the spray operation.

(14) A refractory product produced by the spray method for monolithic refractories described in any one of the above (1) to (13).

Figure 1:
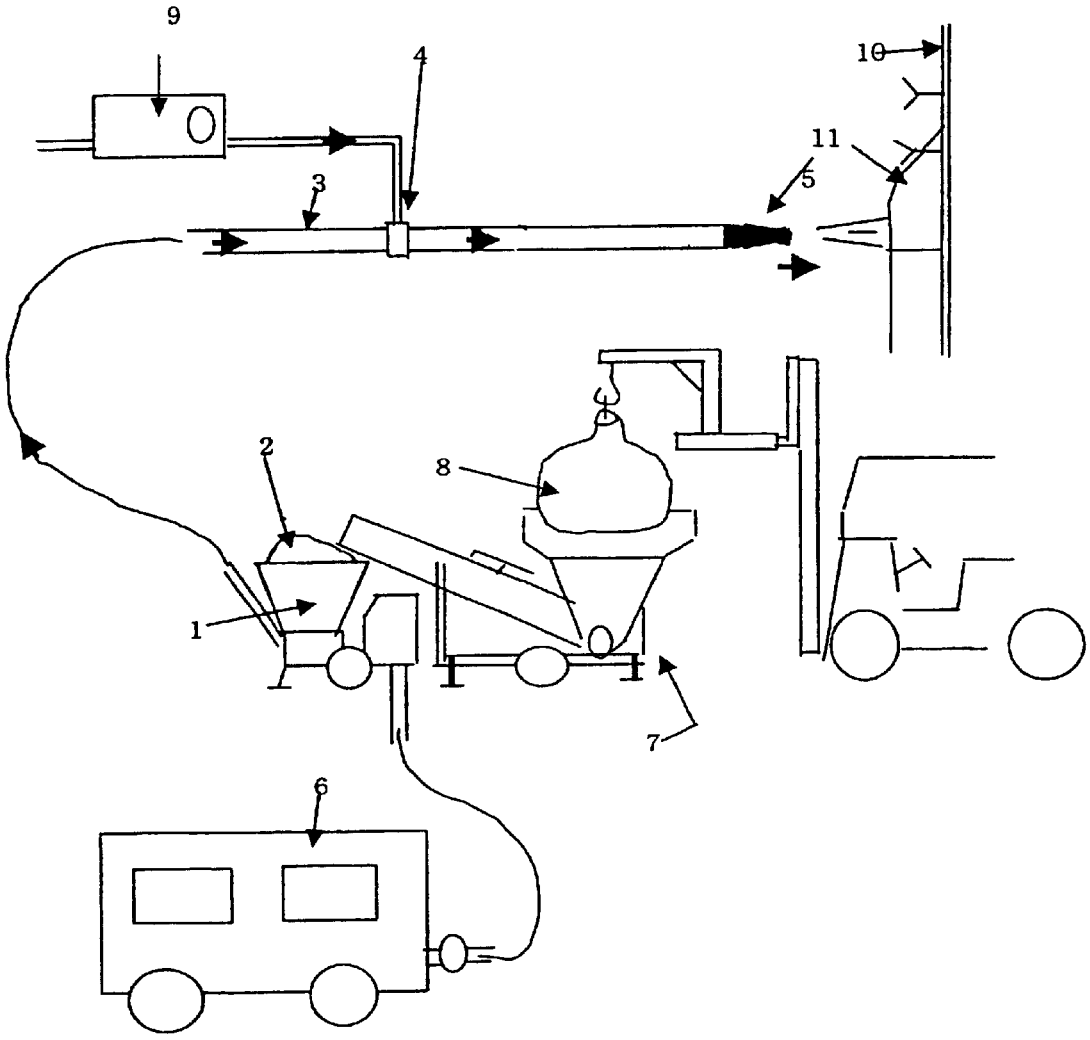
FIG. 1 is a diagram showing an embodiment of carrying out the spray method of the present invention.

In the following, the present invention will be described in more detail.

The powdery monolithic refractory composition used for the spray method of the present invention includes refractory aggregates, a refractory powder, a binder, a dispersant and a rapid setting agent. As the refractory aggregates, at least one member selected from the group consisting of alumina, bauxite, diaspore, mullite, kyanite, aluminous shale, shamotte, silica rock, pyrophillite, sillimanite, andalusite, chromite, spinel, magnesia, zirconia, zircon, chromia, silicon nitride, aluminium nitride, silicon carbide, boron carbide, carbon such as graphite, titanium boride and zirconium boride, is preferably employed.

The refractory aggregates used in the present invention are those having a mean particle diameter of 30 $\mu$m or more. Further, the refractory aggregates have preferably a particle diameter of 12 mm or less, more preferably 10 mm or less. In the grain sizes, e.g., coarse grains, intermediate grains and fine grains, a combination of two kinds or more can be used. In this case, in the relation between the maximum particle diameter of the refractory aggregates and the inner diameter of the transferring pipe, it is preferable that the ratio of the maximum particle diameter of the refractory aggregates/the inner diameter of the transporting pipe is $1/7$–$1/3$. Here, the maximum particle diameter means the smallest screen opening of a sieve, ruled by JISZ8801, through which at least 95% by mass of the particles can pass.

The refractory powder in the refractory composition is to fill spaces among the refractory aggregates and to form binding portions for binding the refractory aggregates, and an ultra-fine refractory powder having a mean particle diameter of not more than 10 $\mu$m, preferably, not more than 5 $\mu$m, is preferably used. As the ultra-fine refractory powder, alumina or fumed silica is desirable. The alumina or fumed silica may be in a powder state, or may be partly in the form of an alumina sol, silica sol or colloidal silica. The refractory powder is preferably 30–60 parts by mass, more preferably, 40–50 parts by mass, per 100 parts by mass of the refractory aggregates.

The refractory powder may contain in addition to the before-mentioned ultra-fine refractory powder, another material having a larger diameter than that powder but having preferably a mean particle diameter of not more than 30 $\mu$m. As such material, alumina, titania, bauxite, diaspore, mullite, aluminous shale, shamotte, pyrophillite, sillimanite, andalusite, silica rock, chromite, spinel, magnesia, zirconia, zircon, chromia, silicon nitride, aluminium nitride, silicon carbide, boron carbide, titanium boride, zirconium boride, bentonite and amorphous silica such as silica may be mentioned. These materials may be used alone or in combination.

In the present invention, the refractory composition may be added with a clayey material contained in a refractory material used for the conventional dry method, such as refractory clay, kaolin or bentonite. Since such clayey material increases its viscosity rapidly upon addition of water, the amount of water to be added should be as small as possible, and it is preferably not more than 3 parts by mass per 100 parts by mass of the refractory aggregates.

The binder in the refractory composition serves as a binder for the monolithic refractories, and aluminous cement is preferably used. When the aluminous cement is used as a binder, the applied body can maintain a sufficient strength within a wide range from room temperature to a high temperature. As the binder, a phosphate such as phosphoric acid or aluminum phosphate, a silicate such as sodium silicate or potassium silicate, a lignin sulfonate, or a water-soluble phenol can be used. The binder is preferably incorporated in an amount of 2.5–20 parts by mass, more preferably, 5–12 parts by mass, per 100 parts by mass of the refractory aggregates.

In the present invention, the dispersant in the refractory composition is an important element. If the dispersant is not included and the application water is incorporated into the powdery composition, the viscosity would increase whereby the transporting pipe would be blocked. The dispersant is preferably composed of at least one member selected from the group consisting of a condensed phosphate such as sodium tetrapolyphosphate or sodium hexametaphosphate, a carboxylate such as polycarboxylate or polyacrylate and a sulfonate such as melamine sulfonate or β-naphthalene sulfonate. The dispersant is preferably incorporated in an amount of 0.02–1.5 parts by mass, more preferably, 0.03–1 part by mass, per 100 parts by mass of the refractory aggregates.

In the present invention, the rapid setting agent in the form of powder or liquid is usable. In order to obtain excellent refractory characteristics by minimizing a necessary amount of water in the mixed batch used for the spray method, a powdery rapid setting agent is preferably used. When a rapid setting agent in the form of aqueous solution is used, a thicker aqueous solution is preferably used because the compactness of the spray-applied body can be maintained.

Further, in the present invention, the rapid setting agent may be contained originally in the refractory composition to be sprayed, comprising the refractory aggregates, the refractory powder, the binder and the dispersant, or the rapid setting agent may not be originally incorporated in the refractory composition wherein it is added to the refractory composition to be sprayed after the application water has been added at a location of upstream from the spray nozzle during the feeding of the refractory composition with an air stream. The selection of either case about the incorporation of the rapid setting agent is determined depending on kinds of rapid setting agent, material for the refractory composition to be sprayed and distances for transporting the refractory material with an air stream from the time of adding the application water to the time of conducting the spray operation. In order to prevent the refractory composition to be sprayed from agglomerating in the transporting pipe as possible and to obtain refractories having excellent quality, it is preferable to employ the later case wherein the rapid setting agent is added to the refractory composition to be sprayed after the application water has been added. It is particularly desirable in a case that the distance of transporting the refractory composition with an air stream after the application water is added, is long. Further, in the case that the rapid setting agent is originally incorporated, it is preferable to use the rapid setting agent in the form of powder rather than that in a liquid form from the same reason.

In the addition of the powdery rapid setting agent, it is preferable to use an apparatus capable of controlling uniformly the amount of the powder to be added, usually, an apparatus for adding the rapid setting agent by compressed air as a carrier. Further, in a case of using the rapid setting agent in the form of liquid, a liquid pump capable controlling uniformly the feed rate is preferably used. Such apparatus can be selected depending on kinds of rapid setting agent used. However, a plunger pump, diaphragm pump or rotary volume type uniaxial eccentric gear pump is preferable.

As the rapid setting agent to be used in the present invention, at least one member selected from the group consisting of a silicate such as sodium silicate or potassium silicate, an aluminate such as sodium aluminate, potassium aluminate or calcium aluminate, a carbonate such as sodium carbonate, potassium carbonate or sodium hydrogen carbonate, a sulfate such as sodium sulfate, potassium sulfate or magnesium sulfate, a calcium aluminate such as $CaO—Al_2O_3$, $12CaO\text{-}7Al_2O_3$, $CaO\text{-}2Al_2O_3$, $3CaO—Al_2O_3$, $3CaO\text{-}3Al_2O_3—CaF_2$ or $11CaO\text{-}7Al_2O_3—CaF_2$, calcium oxide, calcium hydroxide, calcium chloride and a composite or mixture thereof, may be selected. However, the rapid setting agent is not always restricted by the above-mentioned member but any known substance called the rapid setting agent or an agglomeration agent may be used.

Among the above-mentioned rapid setting agents, use of sodium aluminate is preferred because it is easily available, inexpensive and has excellent characteristics. The sodium aluminate has a high melting point. Accordingly, when it is incorporated into the refractory composition, the refractory composition can be cured quickly without reducing the fire resistance of refractories.

When the above-mentioned rapid setting agent is used in the form of powder, the mean particle diameter should be 20–200 $\mu$m, more preferably, 50–100 $\mu$m. The amount of the rapid setting agent to be added varies more or less depending on kinds of rapid setting agent. Accordingly, the incorporation rate should be adjusted in consideration of kinds of rapid setting agent and the distance between the location where the rapid setting agent is incorporated and the spray nozzle. Further, the liquid rapid setting agent may be used by diluting it, and the powdery rapid setting agent may be used as it is or in the form of liquid by dispersing or dissolving it in the medium such as water.

It is preferable that the amount of the rapid setting agent to be added is 0.05–3 parts by mass in terms of dry weight, per 100 parts by mass of the refractory composition excluding the dispersant. If it is less than 0.05 parts by mass, there is a possibility of following out of refractories formed by spray operation due to an insufficient setting speed even though the rapid setting agent has good performance. On the other hand, if it is incorporated beyond 3 parts by mass, there is a possibility that the spray operation becomes difficult due to rapidly curing or a reduction of the performance such as heat resistance or corrosion resistance.

In the spray method of the present invention, the amount of the rapid setting agent to be added to the refractory composition is changed in the spray operation, whereby an applied body having excellent characteristics such as durability can be obtained. For instance, in a case that spaces resulted in the wall of a refractory furnace are to be repaired, there is a method that the rapid setting agent is not added at the start of the operation but is incorporated at a final stage of the operation, preferably just before the completion of the operation, or a method that the rapid setting agent is incorporated in an amount of from several percents by mass to several ten percents by mass with respect to a predetermined amount (the total amount) at the initiation of the spray operation, the amount of adding of the rapid setting agent is increased with the lapse of time of the operation, and finally the remaining (predetermined) amount of the rapid setting agent is incorporated. By employing such methods of incorporating the rapid setting agent, excellent fire resistance characteristics can be obtained because the inside of the applied body contains little or no rapid setting agent. On the other hand, there exists a sufficient amount of rapid setting agent around the surface, and accordingly, there is obtainable the applied body excellent in strength.

In the spray method of the present invention, a retardant may be added in an amount of 0.002–0.2 parts by mass, per 100 parts by mass of the refractory composition as the case requires, whereby the agglomeration time can be controlled, and a stable operation of the refractory composition can be carried out. As the retardant, a weak acid such as oxalic acid, boric acid, malonic acid, citric acid or lignin sulfonate is preferably used.

Next, the present invention will be described in detail with reference to the drawing.

FIG. 1 is a diagram showing an embodiment of the spray method according to the present invention. A powdery refractory composition 2 containing the above-mentioned components and having been subjected to mixing sufficiently is fed in the form of powder into a transporting pipe 3 with use of an airflow type transport machine 1. The airflow type transport machine 1 is not in particular limited as long as it can transport a powder material by air. For example, a gunning machine can be used. At the airflow source for the airflow type transport machine 1, compressed air from a compressor 6 is generally used. The inner diameter of the transporting pipe 3 used is preferably 65 mm or less. If the inner diameter of the transporting pipe exceeds 65 mm, the gunning rate per unit time becomes excessively large. On the contrary, if the inner diameter is excessively small, the pressure loss becomes large. Accordingly, an inner diameter of from 38 mm to 65 mm is preferably used.

The length of the transporting pipe 3 is related to the capacity of the airflow type transport machine 1. In the present invention, however, the spray operation can be carried out even when the location of the airflow type transport machine is remote from the spray nozzle because the refractory composition can be transported in the form of powder. The transporting distance in the conventional wet spray method is at most about 100 m. On the other hand, in the present invention, it is possible to perform a long distance transportation of about 200 m in horizontal distance and about 150 m in height. The transporting pipe 3 is not in particular limited as far as it can connect the airflow type transport machine 1 with the spray nozzle 5, and for example, a known metallic pipe or rubber hose can be used.

Application water is added from an application water supplying portion 4 to the refractory composition 2 which in fed in the transporting pipe 3. The application water supplying portion 4 is preferably disposed at a location of at least 0.3 m upstream from the top end of the spray nozzle 5 in order to mix sufficiently the application water with the refractory composition. In the present case that the rapid setting agent is originally incorporated in the refractory composition 2, the application water supplying portion 4 is at a location of 0.3–15 m upstream from the top end of the spray nozzle 5. When the water is added at a location closer to the spray nozzle 5 with respect to the location of 0.3 m from the top end of the spray nozzle 5, the refractory composition 2 is sprayed through the spray nozzle 5 before the refractory composition 2 is mixed sufficiently with the application water. On the other hand, when the water is added at a location remoter from the location of 15 m from the top end of the spray nozzle 5, the delivery resistance becomes large so that the transporting pipe may be blocked due to an insufficient transporting ability by air. The addition of the application water is in particular preferably carried out at a location of 3–5 m upstream from the top end of the spray nozzle 5.

The amount of water added to the refractory composition 2 in the present invention is substantially the whole amount necessary to form the refractories by the spray operation. Here, "substantially" means the almost whole necessary amount, and a small amount of water may be added at another location as the case requires. For example, an amount of not more than 40% of water to the whole amount of water which is finally required, may be added to the refractory composition 2 to form a so-called premoist in order to prevent the powdery composition from flying. In order to form such premoist, a pre-dampener or the like can appropriately be used. In the present invention, even after the refractory composition becomes a wet condition by the addition of the water, the monolithic refractory composition does not become viscous so that it adheres on the transporting pipe. This is a peculiar phenomenon concerning the monolithic refractory composition of wet state which is obtained by adding the water. However, the above-mentioned can not always be theoretical.

For example, in the study concerning the structure of disperse systems of powder, water and air, these three disperse systems can generally take various structures. The wet refractory composition in the transporting pipe in the present invention creates a so-called "fibrous (II) region" wherein air is confined in continuous particles of powder and water (Umeya: Gakushin 136 committee, literature from study group of monolithic refractory application technology conference). Accordingly, the refractory composition in a wet state in the present invention is supposed to be transported while floating in the transporting pipe. However, this is a presumption of the mechanism and does not restrict the interpretation of the present invention.

When the powdery refractory composition 2 is supplied to the transporting pipe 3, it may be supplied from a storage bag 8 for accommodating the refractory composition 2 to the airflow type transport machine 1 via a quantitative transport machine 7 in the same manner as the conventional method.

Thus, the refractory composition in a wet state is sprayed with the air for transportation through the spray nozzle 5. When the refractory composition is sprayed with a high pressure to an applied portion of a furnace wall structure or the like, the air for transportation escapes into a outside air due to an impact caused when the refractory composition is sprayed to the furnace wall structure. As a result, sprayed refractories after the deaeration agglomerate and cure quickly to form an applied body by the function of the rapid setting agent, whereby a strong furnace wall can be constructed. In the operation, a formwork or the like may be used as the case requires.

Figure 2:
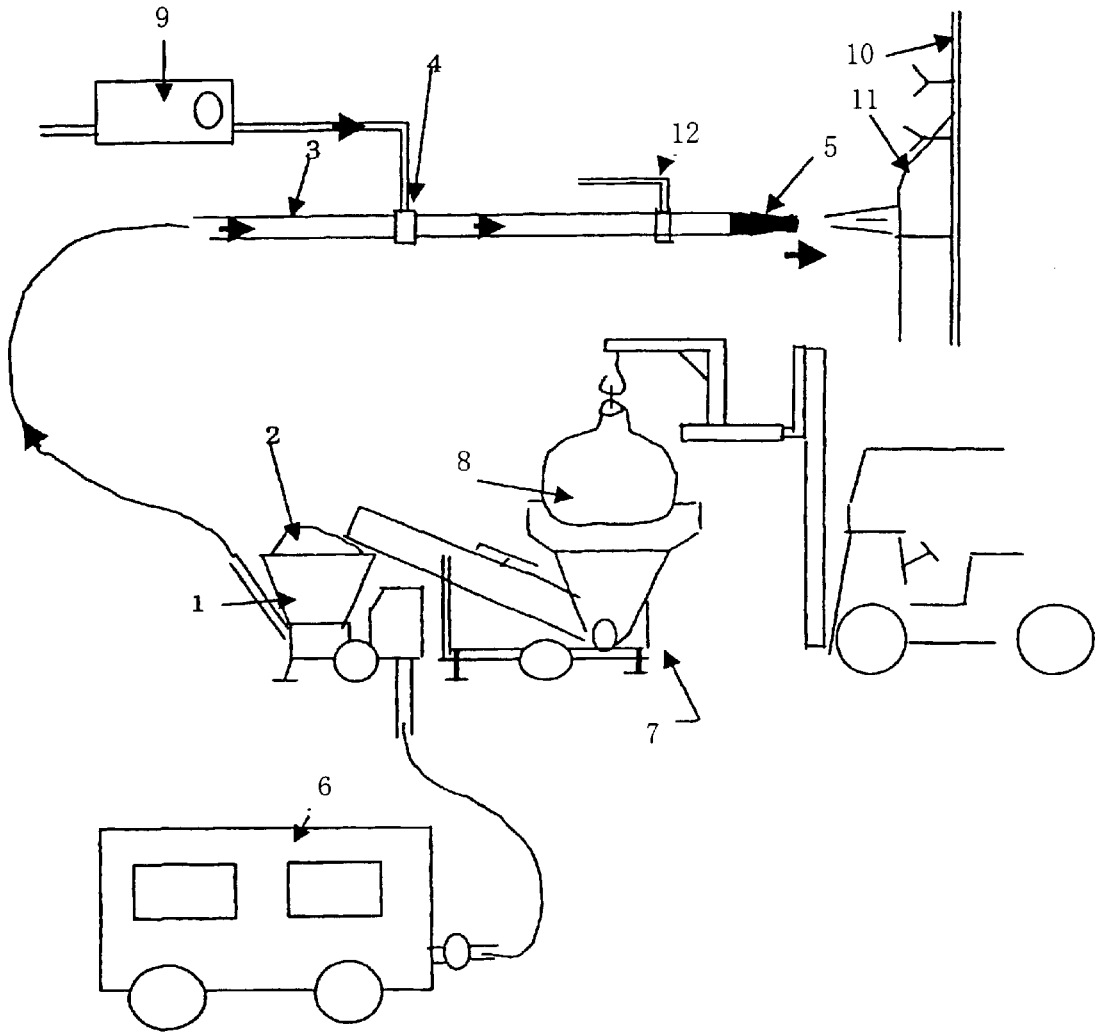
FIG. 2 is a diagram showing another embodiment of carrying out the spray method of the present invention.

FIG. 2 is a diagram showing another embodiment of carrying out the spray method of the present invention. In FIG. 2, description of the parts and portions in common to FIG. 1 is omitted.

In the method shown in FIG. 2, the rapid setting agent is not originally incorporated in the refractory composition 2, and it is added to the refractory composition during the transportation with an air stream in the transporting pipe 3 at a rapid setting agent supplying portion 12 which is provided downstream from the application water supplying portion 4. In this case, the addition of the rapid setting agent is effected preferably at a location of 0.3–2.5 m upstream from the top end of the spray nozzle 5. If the addition of the rapid setting agent is effected at a location closer to the top end of the spray nozzle 5 than the location of 0.3 m upstream from the top end, a sufficient agglomeration effect can not be obtained because it is impossible to mix sufficiently uniformly the rapid setting agent with the refractory composition. On the other hand, if the rapid setting agent is added at a location remoter from the top end of the spray nozzle 5 with respect to the location of 2.5 m upstream, the refractory composition 2 would solidify on the way of the transporting pipe 3, whereby the transporting pipe 3 and the spray nozzle 5 may be blocked.

Further, in a case that the rapid setting agent is added at the rapid setting agent supplying portion 12 disposed on the way of the transporting pipe 3, the position of the application water supplying portion 4 is preferably 1–50 m upstream from the rapid setting agent supplying portion 12. If the addition of water is carried out at a location where the distance from the rapid setting agent supplying portion 12 is shorter than 1 m, there results that the rapid setting agent is added before the mixing of the application water with the refractory composition 2 becomes sufficient, and the solidification of the refractory composition 2 begins undesirably. On the other hand, if the water is added at a location where the distance from the rapid setting agent supplying portion 12 is more than 50 m, the delivery resistance becomes large because of the addition of the water, with the result that the transporting pipe may be blocked due to an insufficient transportation ability with the compressed air. The water is preferably added at a location of 3–10 m upstream from the rapid setting agent supplying portion 12. Thus, when the rapid setting agent is added at the downstream of the application water supplying portion 4, the distance between the application water supplying portion 4 and the top end of the spray nozzle 5 can be elongated in comparison with the case that the rapid setting agent is originally incorporated in the refractory composition.

Further, when the rapid setting agent is added to the refractory composition in a wet state at the downstream of the application water supplying portion 4 as shown in FIG. 2, the mixing of the rapid setting agent with the refractory composition can be uniform, whereby the refractory composition in which the water and the rapid setting agent are dispersed uniformly in the refractory composition can be obtained. Thus, the refractories formed by spraying the refractory composition have uniform quality and excellent physical properties. More specifically, the flexural strength can be increased and the width of scattering of the flexural strength is small. Further, when the rapid setting agent is added at the downstream of the application water supplying portion 4, it is possible to use equally the rapid setting agent of either a powder state or a liquid state.

Figure 3:
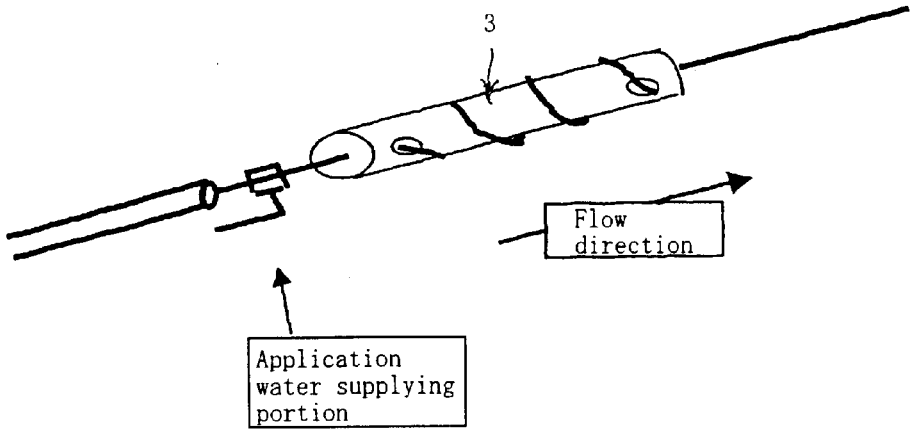
FIG. 3 is a diagram showing a spiral system as an embodiment of the mixing acceleration means for mixing application water with a refractory composition according to the present invention.
Figure 4:
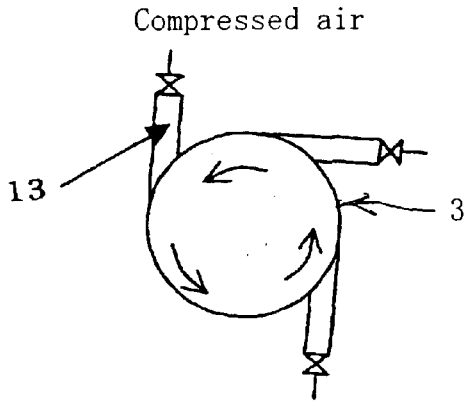
FIG. 4 is a diagram showing a whirling type as another embodiment of the mixing acceleration means of the present invention.
Figure 5:
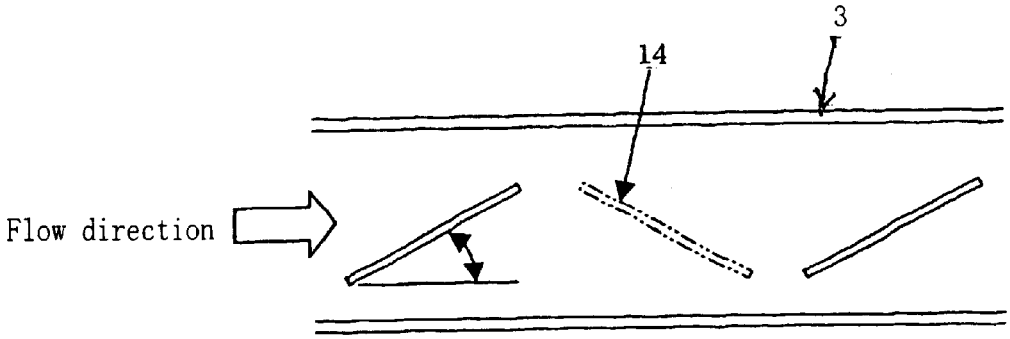
FIG. 5 is a diagram in cross section showing another embodiment of the mixing acceleration means of the present invention.

Further, after the application water is added to the powdery refractory composition on the way of the transporting pipe 3, means for accelerating the uniformly mixing of the refractory composition and the application water may be provided so that the both members can further be mixed uniformly. FIGS. 4 and 5 show such uniformly mixing means. FIG. 3 shows a spiral system in which a portion of the transporting pipe 3 is twisted into a spiral shape so that the mixing is accelerated by reversing spirally the refractory composition fed in the transporting pipe by the air stream. FIG. 4 shows a whirling system in which a compressed air gunning port 13 is provided at an outer periphery in a portion of the transporting pipe 3 so that a whirling action is forcibly caused by compressed air so as to cause the revolution of the refractory composition in the transporting pipe 3 during the transportation by the air stream to thereby accelerate the mixing. FIG. 5 shows a guide plate system in which a guide plate 14 (having a fitting angle of, preferably, 45° or less) at an inner periphery in a portion of the transporting pipe 3 to cause a revolving action so that the flow of the refractory composition in the transporting pipe is disturbed to thereby accelerate the mixing.

EXAMPLE

Now, the present invention will be described in detail with reference to Examples. However, it should be understood that the present invention is by no means restricted by such specific examples.

Example 1

Comparative tests were conducted about applied bodies obtained by the spray method of the present invention and the conventional wet and dry spray methods respectively. Results of the Comparative tests are shown hereinbelow.

Tested material: Table 1 shows the components of the refractory composition used for spraying. The content of each component is shown by a numerical value in terms of part(s) by mass, per 100 parts by mass of the refractory composition excluding the dispersant and the retardant.

The dispersant and the retardant are shown by the numerical value in part(s) by mass, per 100 parts by mass of the refractory aggregates.

Test procedure: Each 5 panels of 400 mm long×400 mm wide×100 mm thick were prepared by each spray method. After drying the panels, the physical properties of the panels were compared. Table 2 shows test results.

TABLE 1

| | Method | | |
|---|---|---|---|
| | Method of | Conventional method | |
| Refractory composition | present invention | Wet Spray method | Dry Spray method |
| Refractory aggregates | | | |
| Shamotte coarse particles 10–3.5 mm | 10 | 10 | — |
| Intermediate particles 3.5–1.18 mm | 25 | 25 | 31 |
| Fine particles 1.18–0.15 mm | 20 | 20 | 30 |
| Pulverized particles not more than 0.15 mm (mean particle diameter: 75 μm) | 10 | 10 | — |
| Bauxite Pulverized particles not more than 0.15 mm (mean particle diameter: 75 μm) | — | — | 16 |
| Refractory powder | | | |
| Alumina (mean particle diameter:: 4 μm) | 7.5 | 7.5 | — |
| Fumed silica (mean particle diameter: 0.5 μm) | 7.5 | 7.5 | — |
| Bauxite (mean particle diameter: 20 μm) | 15 | 15 | — |
| Refractory clay | — | — | 8 |
| Aluminous cement (alumina 70% class) | 5 | 5 | 15 |
| Dispersant Sodium tetrapolyphosphate | 0.1 | 0.1 | — |
| Rapid setting agent Sodium aluminate in powder state | 1 | 1 (Note 1) | — |

TABLE 1-continued

| | Method | | |
|---|---|---|---|
| | Method of | Conventional method | |
| Refractory composition | present invention | Wet Spray method | Dry Spray method |
| Retardant Oxalic acid | 0.02 | 0.02 | — |

(Note 1): The addition was carried out at a position 0.5 m apart from the top end of the spray nozzle.

TABLE 2

| | Method | | |
|---|---|---|---|
| | Method of | Conventional method | |
| Items | present invention | Wet spray method | Dry Spray method |
| Chemical component (mass %) | | | |
| $Al_2O_3$ | 52 | 52 | 54 |
| $SiO_2$ | 44 | 44 | 39 |
| Maximum particle diameter (mm) | 10.0 | 10.0 | 3.5 |
| Transporting pipe | | | |
| Inner diameter (mm) | 38 | 38 | 38 |
| Entire length (m) | 100 | 100 | 100 |
| Location of addition of water | 10 m upstream from top end of nozzle | During mixing with mixer | 0.3 m upstream from top end of nozzle |
| With or without using rapid setting agent | Inclusion in composition | Added at nozzle portion | Without using |
| Transport machine | Airflow gunning machine Note 1 | W-piston pump | Airflow gunning machine Note 1 |
| Amount of water added (mass %) | 7.8 | 8.1 | 11.2 |
| Bulk density % (g/cm$^3$) | 2.23 | 2.20 | 2.17 |
| 110° C. after drying | 2.22 | 2.21 | 2.24 |
| | 2.23 | 2.17 | 2.20 |
| | 2.22 | 2.21 | 2.21 |
| | 2.21 | 2.18 | 2.26 |
| [Width of scattering: %] Note 2 | [0.9] | [1.8] | [4.1] |
| Flexural strength (MPa) | 10.93 | 9.73 | 6.37 |
| 110° C. after drying | 10.42 | 10.31 | 4.41 |
| | 11.40 | 10.67 | 5.36 |
| | 10.72 | 9.52 | 6.27 |
| | 10.78 | 10.97 | 6.71 |
| [Width of scattering: %] Note 2 | [9.0] | [14.2] | [39.5] |
| Observation of cut surface of applied body | | | |
| Irregular distribution of aggregates | None | Slight | Yes |
| Lamination | None | None | None |
| Filling properties | Good | Good | Good |

Note 1: As the airflow transport machine, a gunning machine (Trade name: Needgun 400 manufactured by Plibrico Japan co. was used.
Note 2: The width of scattering was obtained by dividing the difference between the maximum and minimum values of n = 5 by the mean value, and the obtained value is expressed by "%".

From Table 2, it is found that according to the spray method of the present invention, the scattering of the physical properties of the refractories after the drying is small in comparison with that of the conventional dry and wet spray methods. This shows that the structure of the applied body formed by the spray method of the present invention is homogeneous in comparison with the conventional spray methods. Further, according to the spray method of the present invention, the refractory composition is well mixed with water. Accordingly, the amount of the application water can be smaller than that in the conventional wet spray method with the result that an applied body of high quality can be obtained.

Example 2

Table 3 shows a result obtained by comparing the man-hour of the spray method of the present invention with the man-hour of the conventional wet spray method.

Material used for Spraying: same as Example 1

Location of spray application: preheater cyclone (50 m high from the ground) of a cement plant

TABLE 3

| Items of methods | Method of present invention | Conventional method W-piston-pump-used wet spray method |
|---|---|---|
| Applied area | 120 $m^2$ | |
| Quantity consumed by the operation | 60,000 kg | |
| Number of workers | Initial setup and posttreatment: 1 day × 5 persons = 5 persons<br>Scaffold and removal: 2 days × 6 = persons = 12 persons<br>Spray: 3 days × 5 persons = 15 persons<br>Total: 6 days 32 persons | Initial setup and posttreatment: 3 days × 8 persons = 24 persons<br>Scaffold and removal: 2 days × 6 = persons = 12 persons<br>Spray: 3 days × 8 persons = 24 persons<br>Total: 8 days 60 persons |
| Result of comparison | The operation of the present invention could achieve a 46% reduction in the number of workers and a 25% reduction in construction time in comparison with the wet spray method. | |

It is found from Table 3 that the spray method of the present invention has been able to achieve a remarkable reduction of the man-hour and construction time in comparison with the conventional wet spray method.

Example 3

Tests were conducted to find the proper location at which the application water should be added to the refractory composition flowing in the transporting pipe in the spray method of the present invention. Table 4 shows a result.

Tested Material: same as Example 1.

Test procedure: a transporting pipe having an inner diameter of 38 mm and a length of 100 m was connected to an airflow type transport machine, and the refractory composition was sprayed to a panel (1,000 mm long×1,000 mm wide) while the location of adding the application water, namely, the location of the application water supplying portion 4 is changed, and the comparison of the characteristics was made. A discharge rate of 3,000 kg/hour and a spraying pressure of 0.6 MPa were kept constant.

Qualitative evaluation was made as to whether the discharge performance was good or no good, and the spray loss was generated or not, and as to synthetic judgment of applicability. In Table 4, a mark ○ indicates a level that there is no trouble, a mark Δ indicates a level of practically usable, and a mark × indicates a level that a trouble may occur.

TABLE 4

| Spray properties | Location of supplying application water (at the upstream side from the top end of the nozzle) | | | | | |
|---|---|---|---|---|---|---|
| | 0.2 m | 0.3 m | 1.0 m | 10 m | 15 m | 20 m |
| Pulsation of hose | None | None | None | None | Slight | Yes |
| Discharge performance | ○ | ○ | ○ | ○ | Δ | X |
| With or without spray loss | X Insufficiently mixing | Δ | ○ | ○ | ○ | X Blocking of transporting pipe |
| Bulk density g/$cm^3$ | 2.18 | 2.20 | 2.23 | 2.22 | 2.22 | Immeasurable |
| Lamination | Yes | None | None | None | | |
| Irregular distribution of aggregates | Yes | Yes | None | None | None | |
| Filling properties | No good | Good | Good | Good | Good | |
| Synthetic judgment of applicability | X | Δ | ○ | ○ | ○ | X |

Note: The bulk density indicates the value after the drying at 110° C.

It is found from Table 4 that the proper location of adding the application water in the spray method of the present invention is in a range of from 0.3 to 15 m.

Example 4

Comparative tests were conducted to an applied body according to the spray method of the present invention wherein the rapid setting agent is added at the downstream of the application water supplying portion (FIG. 2), and to applied bodies obtained by the conventional wet and dry spray methods. Results of the Comparative tests are shown hereinbelow.

Tested Material: same as Table 1.

Test procedure: each 5 panels having a size of 400 mm long×400 mm wide×100 mm thick were prepared by each of the spray methods. The prepared panels were dried, and the physical properties of these panels were compared. The test results are shown in Table 5.

As is clear from Table 5, according to the applied body obtained by the method of the present invention, the physical properties of the refractories after the drying are excellent, and the scattering of the physical properties is small in comparison with the applied bodies by the conventional wet and dry spray methods. This shows that the structure of the applied body formed by the spray method of the present invention is homogeneous. Further, according to the method of the present invention, the refractory composition is well mixed with water, and the amount of the application water can be smaller than that in the conventional wet spray method, with the result that the applied body of high quality can be obtained.

In comparison of the case of Example 4 with the case of Example 1 wherein the rapid setting agent is originally incorporated in the refractory composition, the refractories after the drying according to Example 4 have larger bulk density and flexural strength than those of Example 1, and the width of scattering of the flexural strength is small, and accordingly, the characteristics are superior to the refractories of Example 1.

TABLE 5

| Items | Method: Method of present invention | Conventional method: Wet spray method | Conventional method: Dry spray method |
|---|---|---|---|
| Chemical component (mass %) | | | |
| $Al_2O_3$ | 52 | 52 | 54 |
| $SiO_2$ | 44 | 44 | 39 |
| Maximum particle diameter (mm) | 10.0 | 10.0 | 3.5 |
| Transporting pipe | | | |
| Inner diameter (mm) | 38 | 38 | 38 |
| Entire length (m) | 100 | 100 | 100 |
| Location of addition of water (m) | 10 m upstream from top end of rapid setting agent supplying portion | During mixing with mixer | 0.3 m upstream from top end of nozzle |
| With or without using rapid setting agent | Using | Using | Without Using |
| Amount of addition of sodium aluminate in power state Note 1 | 1 | 1 | — |
| Transport machine | Airflow gunning machine Note 2 | W-piston pump | Airflow gunning machine Note 2 |
| Amount of water added (mass %) | 7.3 | 8.1 | 11.2 |
| Bulk density % (g/cm$^3$) | 2.28 | 2.20 | 2.17 |
| 110° C. after drying | 2.27 | 2.21 | 2.24 |
| | 2.28 | 2.17 | 2.20 |
| | 2.27 | 2.21 | 2.21 |
| | 2.26 | 2.18 | 2.26 |
| [Width of scattering: %] Note 2 | [0.9] | [1.8] | [4.1] |
| Flexural strength (MPa) | 12.36 | 9.73 | 6.37 |
| 110° C. after drying | 12.43 | 10.31 | 4.41 |
| | 11.40 | 10.67 | 5.36 |
| | 12.02 | 9.52 | 6.27 |
| | 12.46 | 10.97 | 6.71 |
| [Width of scattering: %] Note 3 | [8.7] | [14.2] | [39.5] |
| Observation of cut surface of applied body | | | |
| Irregular distribution of aggregates | None | Slight | Some |
| Lamination | None | None | Some |
| Filling properties | Good | Good | Good |

Note 1: The amount of addition is a numerical value in part(s) by mass, per 100 parts by mass of the refractory composition, and the location of the addition is 0.5 m upstream from the top end of the spray nozzle.
Note 2: As the airflow transport machine, a gunning machine (trade name: Needgun 400 manufactured by Plibrico Japan Co. was used.
Note 3: The width of scattering was obtained by dividing the difference between the maximum and minimum values of n = 5 by the mean value, and the obtained value is expressed by "%".

Example 5

In the spray method of the present invention, tests were conducted to find the proper location where the application water should be added to the refractory composition to be sprayed flowing in the transporting pipe. Table 6 shows a result.

The tested material and the test procedure are the same as those in Example 3.

TABLE 6

| Spray properties | Location of supplying application water (at the upstream side from the location where the rapid setting agent is added): 1 m | 2 m | 10 m | 40 m | 50 m | 60 m |
|---|---|---|---|---|---|---|
| Pulsation of hose | None | None | None | None | None | Yes |
| Discharge performance | ○ | ○ | ○ | ○ | ○ | X |
| Wet condition | X Insufficiently wetting | ○ | ○ | ○ | ○ | X Blocking of transporting pipe |

From Table 6, it is found that the proper location of adding the application water in the method of the present invention is in a range of not more than 50 m at an upstream side from the location where the rapid setting agent is added.

Example 6

In the spray method of the present invention, tests were conducted to find the proper position of adding the rapid setting agent to monolithic refractory composition in a wet state. Table 7 shows a result.

Tested material: the same shamotte type refractory composition as Example 1 was used.

Test procedure: a transporting pipe of 38 mm inner diameter×100 m long was connected. The location of the addition of the rapid setting agent was changed while the location of the application water supplying portion 4 was kept constant at a location of 10 m from the rapid setting agent supplying portion 12. The refractory composition was sprayed to each panel (1,000 mm long×1,000 mm wide) to compare the characteristics. Further, a sample of panel (400 mm long×400 mm wide×100 mm thick) was prepared to compare the physical properties.

A discharge rate of 3,000 kg/hour, a spray pressure of 0.6 MPa and an amount of addition of the rapid setting agent of 1.0% by mass were kept constant.

TABLE 7

| Spray properties | Location of adding rapid setting agent (from top end of spray nozzle): 0.2 m | 0.3 m | 0.4 m | 2 m | 2.5 m | 3 m |
|---|---|---|---|---|---|---|
| Discharge performance | ○ | ○ | ○ | ○ | ○ | X Blocking of transporting pipe |
| Evaluation of outer appearance of sprayed body | X | ○ | ○ | ○ | ○ | X Impossibility of spraying Immeasurable |
| Comparison of physical properties | | | | | | |
| Bulk density g/cm$^3$ | 2.20 | 2.22 | 2.23 | 2.22 | 2.22 | |
| Lamination | Yes | None | None | None | None | |
| Irregular distributing of aggregates | Yes | None | None | None | None | |

TABLE 7-continued

| | Location of adding rapid setting agent (from top end of spray nozzle) | | | | | |
|---|---|---|---|---|---|---|
| Spray properties | 0.2 m | 0.3 m | 0.4 m | 2 m | 2.5 m | 3 m |
| Filling properties | Good | Good | Good | Good | Good | |
| Judgment | X | ○ | ○ | ○ | ○ | X |

Note 4: The bulk density indicates values after the drying at 110° C. The judgment of the discharge performance was conducted in the same manner as those in Table 4. The appearance of the sprayed applied body was evaluated visually. A mark ○ indicates no lamination or non-uniformity (for example, there is a portion of powder state), and a mark X indicates other than the case indicated by the mark ○.

From Table 7, it is found that the preferable location of addition of the rapid setting agent in the method of the present invention is in a range of from 0.3 to 2.5 m.

According to the present invention, a new spray method wherein the problems of the conventional wet and dry spray methods can be solved, is provided. Namely, the spray method of the present invention provides the following main advantages.

(1) Since the powdery refractory composition is transported by an air stream, a mixing operation of the refractory composition to be sprayed with use of a large-sized mixer is unnecessary. Further, it is unnecessary to use a pump for forcibly feeding a mixture which causes a large pressure loss.

(2) In the conventional wet spray method wherein the refractory composition is transported in a state of mixed batch, the transportation distance from the top of the spray nozzle to the location to be sprayed is at most about 100 m in horizontal distance and at most about 60 m in height. In the present invention, however, since the application water is mixed with the refractory composition in the transporting pipe, the blocking of the refractory material in the transporting pipe would not occur, and it is possible to carry out a long distance transportation of about 200 m and the spray operation at a location as high as about 150 m. In particular, a remarkable effect can be obtained when the rapid setting agent is added to the refractory composition at a location of downstream from the location where the application water is added, in a predetermined distance range from the top end of the spray nozzle.

(3) Since there is little possibility that the refractory composition adheres on the inner wall of the transporting pipe, or it remains in the transporting pipe after the spray operation, maintenance work is extremely easy.

(4) The operation time can substantially be reduced since the mixing is unnecessary.

(5) It is possible to reduce the loss of the refractory material because an amount of the adhesion on the transporting pipe can be reduced.

(6) Refractories obtained by the spraying have excellent properties such as uniform quality and large strength.

(7) By incorporating previously the rapid setting agent in the refractory composition, it is unnecessary to provide an equipment to add the rapid setting agent on the way of the transporting pipe, whereby the control of the addition is unnecessary.

The entire disclosures of Japanese Patent Application No. 2001–008263 filed on Jan. 16, 2001 and Japanese Patent Application No. 2001–008307 filed on Jan. 16, 2001 including specifications, claims, drawings and summaries are incorporated herein by reference in their entireties.

What is claimed is:

1. A spray method for monolithic refractories, comprising:

feeding an air stream and a powdery monolithic refractory composition including refractory aggregates, a refractory powder, a binder, a rapid setting agent and a dispersant in a transporting pipe from a source toward a spray nozzle so that the powdery monolithic refractory composition is transported in a floating state;

adding application water from a portion of the transporting pipe such that a wet monolithic refractory composition is formed in the transporting pipe while continuing the feeding of the air stream; and spraying the wet monolithic refractory composition through the spray nozzle.

2. The spray method for monolithic refractories according to claim 1, wherein the ratio of the maximum particle diameter of the refractory aggregates/the inner diameter of the transporting pipe is 1/7–1/3.

3. A refractory product produced by the spray method for monolithic refractories according to claim 1.

4. The spray method for monolithic refractories according to claim 1, wherein the amount of the rapid setting agent to be added to the monolithic refractories is changed during the spray operation.

5. The spray method for monolithic refractories according to claim 1, wherein the rapid setting agent comprises at least one member selected from the group consisting of a silicate, an aluminate, a carbonate and a sulfate of an alkali metal or alkaline earth metal.

6. The spray method for monolithic refractories according to claim 1, wherein the amount of the rapid setting agent to be added is 0.05–3 parts by mass in terms of dry weight, per 100 parts by mass of the monolithic refractory composition excluding the dispersant.

7. The spray method for monolithic refractories according to claim 1, wherein the application water is added at a location of 0.3–15 m upstream from the top end of the spray nozzle.

8. The spray method for monolithic refractories according to claim 1, wherein means for mixing uniformly the application water and the monolithic refractory composition in the transporting pipe are provided downstream from the location where the application water is added, and after the application water has been added, the application water is further mixed uniformly with the monolithic refractory composition.

9. The spray method for monolithic refractories according to claim 1, wherein the contents of the refractory powder, the binder, the dispersant and the rapid setting agent are 30–60 parts by mass, 2.5–20 parts by mass, 0.03–1.5 parts by mass and 0.07–4.5 parts by mass, respectively, per 100 parts by mass of the refractory aggregates.

10. The spray method for monolithic refractories according to claim 1, wherein the refractory powder is a ultra-fine refractory powder having a mean particle diameter of 10 $\mu$m or less; the binder is aluminous cement, and the dispersant is a condensed phosphate, a carboxylate or a sulfonate.

* * * * *